United States Patent [19]

Okamura et al.

[11] Patent Number: 4,956,983

[45] Date of Patent: Sep. 18, 1990

[54] LOCKING APPARATUS WITH A KEY

[75] Inventors: Naokatsu Okamura; Noboru Yamaguchi; Shuji Masuda; Noboru Kanou, all of Aichi, Japan

[73] Assignee: Kabushiki Kaisha Tokai Rika Denki Seisakusho, Aichi, Japan

[21] Appl. No.: 404,565

[22] Filed: Sep. 8, 1989

[30] Foreign Application Priority Data

Sep. 22, 1988 [JP] Japan ..... 63-124030[U]
Sep. 22, 1988 [JP] Japan ..... 63-124031[U]

[51] Int. Cl.[5] ..... E05B 65/19

[52] U.S. Cl. ..... 70/241; 70/257; 70/360; 70/DIG. 27; 70/DIG. 30; 70/DIG. 57; 200/43.13

[58] Field of Search ..... 70/DIG. 30, DIG. 57, 70/DIG. 20, DIG. 27, 360, 361, 241, 371, 255, 257; 200/43.08, 43.13

[56] References Cited

U.S. PATENT DOCUMENTS

| | | | |
|---|---|---|---|
| 1,253,470 | 1/1918 | Cox | 70/DIG. 57 X |
| 1,814,258 | 7/1931 | Norviel | 200/43.13 |
| 1,951,418 | 3/1934 | Jacobi | 70/DIG. 27 X |
| 2,060,951 | 11/1936 | Rae et al. | 70/DIG. 30 X |
| 4,401,247 | 8/1983 | Zoor | 70/DIG. 57 X |
| 4,792,784 | 12/1988 | Kaplan | 70/371 X |
| 4,875,350 | 10/1989 | Faust | 70/241 |

FOREIGN PATENT DOCUMENTS

| | | | |
|---|---|---|---|
| 1030017 | 3/1953 | France | 70/360 |
| 1-129725 | 9/1989 | Japan . | |

*Primary Examiner*—Lloyd A. Gall
*Attorney, Agent, or Firm*—Finnegan, Henderson, Farabow, Garrett, and Dunner

[57] ABSTRACT

A locking apparatus with a key comprising a cylindrical body, a cylindrical operation member mounted inside the body, a first spring for returning the operation member to an original position, a key rotor mounted inside the operation member, a second spring for urging the key rotor to rotate to an original position, a limiting member provided in the key rotor, a third spring for urging the limiting member to project outwardly from the key rotor, an engagement portion disposed in the body, the engagement portion being engaged with the limiting member projected outwardly by the third spring when the operation member is pushed inwardly by a predetermined stroke along the axis against the first spring by a manual operation, and a disengagement portion provide in the body, the disengagement portion unlocking the limiting member from the engagement portion thereby returning the operation member and the key rotor to original positions under the elastic forces of the first and second springs in response to rotation of said key rotor.

10 Claims, 6 Drawing Sheets

LOCKING APPARATUS WITH A KEY

FIELD OF INVENTION

The present invention relates to a key-locking apparatus in which an operation member can be maintained in a locked position when the operation member is manually pushed inward, and returned to an unlocked state when a key rotor is rotated with a key.

BACKGROUND OF THE INVENTION

In Japanese Utility Model Application No. 63-25251, the present applicants have proposed a car trunk opener apparatus having a manual operation switch provided near a driver's seat to be operated by electrical actuation rather than general mechanical actuation. The Japanese Utility Model Application discloses a key switch for deactivating the operation of the manual operation switch. This is provided, for example, to prevent unauthorized persons from opening the trunk lid even when the car keys are left on check at a parking lot and even if the doors are left unlocked.

According to the Japanese Utility Model Application, when the manual operation switch needs to be deactivated to lock the trunk, the key rotor, with the key inserted therein, is rotated to a locked position. When the manual operation switch needs to be activated to leave the trunk in an unlocked state, the key rotor, with the key inserted therein, is again rotated to turn the rotor to its canceling position.

There are a number of drawbacks with the device described above. First, when the car needs to be left on check at a parking lot as described above, the driver will, in most cases, leave the engine running. However, the above device requires that the driver turn off the engine, and remove the key from the ignition to lock the trunk. This procedure is cumbersome. Further, the Japanese Utility Model Application merely discloses a key switch but does not disclose the construction of a portion of the key switch that is installed inside the car. Accordingly, even when the key switch is locked, it may be possible for a burglar to remove the key switch from a mounting portion such as an instrument panel using a tool and thereby open the trunk.

The aforementioned disadvantages also arise with mechanically operated glove boxes.

SUMMARY OF THE INVENTION

It is therefore a first object of the present invention to provide a locking apparatus, in which the key is required only to cancel a locked state. In other words, the locked state can be obtained without using a key.

It is a second object of the invention to provide a locking apparatus with a key, in which a shielding plate is provided to cover mounting screws making it impossible to use any tool to remove the lock in the locked state. Accordingly, the invention is highly reliable for preventing burglars from circumventing the lock.

The foregoing and other objects of the invention can be achieved by a locking apparatus which, according to the invention, comprises: a cylindrical body having an axis; a cylindrical operation member placed inside the body to be reciprocatingly movable along the axis thereof and urged by a first spring to return to its original position; a key rotor placed in the inside of the operation member, the key rotor being rotatable relative to the operation member and movable together with the operation member along the axis relative to the body, the key rotor being rotatable relative to the operation member by insertion of a key and urged by a second spring to rotate to its original position; a limiting member provided in the key rotor and urged by a third spring to project outwardly from the outside of the key rotor; an engagement portion provided in the body to engage the limiting member projected outwardly by the third spring when the operation member is moved inwardly by a predetermined stroke along the axis against the first spring by a manual operation; and a disengagement portion provided in the body to unlock the limiting member from the engagement portion to thereby return the operation member and the key rotor respectively to their original positions by the spring forces of the first and second springs when the operation member kept in a locked position is rotated against the second spring with the key inserted.

In the apparatus mentioned above, the locked state can be attained only by pushing the operation member inwardly. Therefore, the key is not used for moving the operation member to its locked state. Accordingly, the locking operation can be performed speedily and easily compared with the conventional apparatus. Consequently, the apparatus according to the present invention has excellent handling properties.

DESCRIPTION OF THE PREFERRED EMBODIMENT

Figure 1:
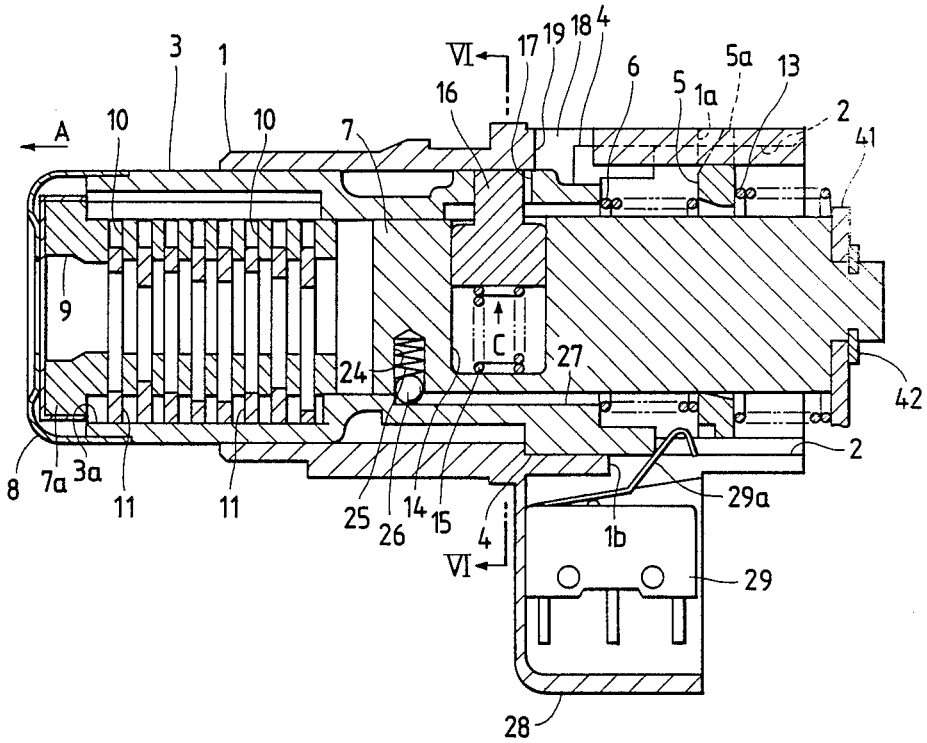
FIG. 1 is a longitudinal sectional view of the locking apparatus according to the present invention.

An embodiment of the present invention will now be described in detail with reference to accompanying drawings.

A locking apparatus of the invention is provided with a cylindrical body 1 formed of a material such as plastic. The body 1 has four concave portions 2 disposed in the rear (right side in the drawings) inside thereof, parallel to the central axis of the body 1 and at equal intervals therefrom. A cylindrical operation member 3 is mounted inside the body 1. The operation member 3 has four convex portions 4 formed in the read end thereof to fit into and be guided by the concave portions 2. This configuration allows operation member 3 to be axially slidable with respect to the body 1. An annular spring support 5 is provided on the inside of the body 1 opposite the rear end portion of the operation member 3. The spring support 5 is positioned by the engagement of a plurality of outer claws 5*a* with a plurality of fitting holes la. A first spring 6 constituted by a compression coiled spring for urging the operation member 3 toward an original position, (in the direction of the arrow A in FIG. 1), is disposed between the spring support 5 and the rear end of the operation member 3.

A key rotor 7 is rotatably supported by the inner periphery of the operation member 3. A flange portion 7a formed on the front end of the key rotor 7 is disposed between the front end surface of the operation member 3 and a cover 8 caulked to the front end portion of the operation member 3. A slit-like keyhole 9 is formed to open to the front surface of the key rotor 7. Tumblers 11 are respectively slidably provided in slit-like tumbler holes 10 formed in the key rotor 7. The tumblers 11 are disposed perpendicular to the keyhole 9. When key 12 is inserted in the keyhole 9 as shown in FIG. 2, the respective opposite ends of the tumblers 11 are made even with the outer circumference of the key rotor 7 so that the key rotor 7 is rotatable relative to the operation member 3. In contrast, when the key 12 is removed from the keyhole 9 as shown in FIG. 1, the respective ends of the tumblers 11 are fitted into a locking groove 3a to prevent rotation of the key rotor 7.

Figure 2:
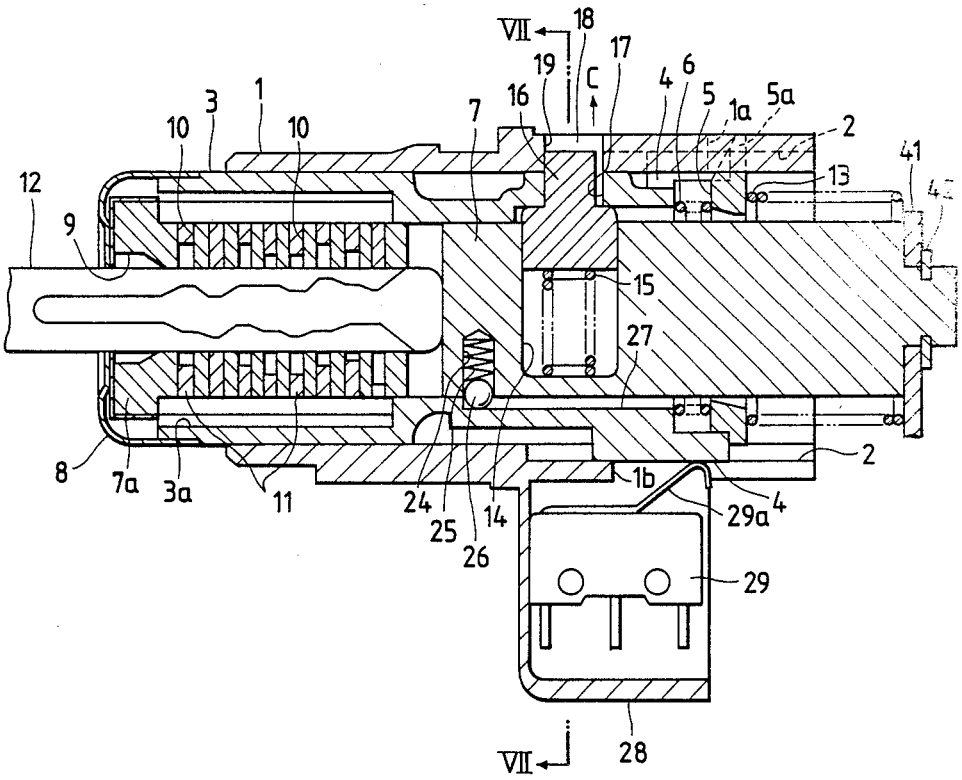
FIG. 2 is a longitudinal sectional view of the locking apparatus in an operational state different from that of FIG. 1.
Figure 5:
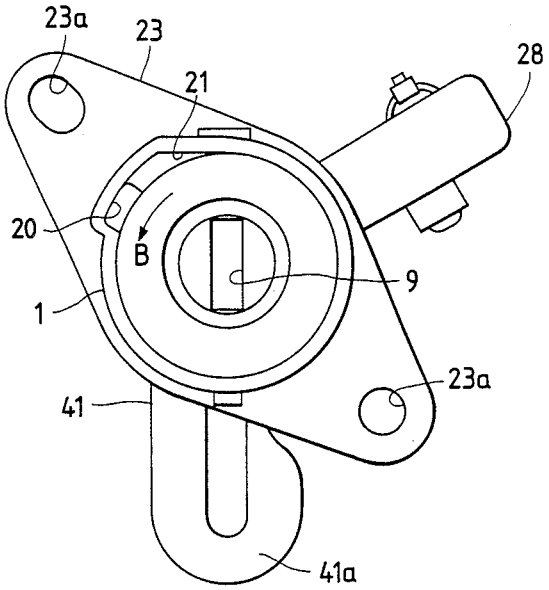
FIG. 5 is a front view showing the state where the cover frame has been removed.

When the key is inserted in the keyhole 9, the key rotor 7 can be rotated by about 60° in the direction of the arrow B (in FIG. 5) from the original position shown in FIGS. 1 and 5. A second spring 13 constituted by a torsional coiled spring is provided in the rear end portion of the key rotor 7. The second spring 13 urge the key rotor 7 to rotate in a direction opposite the direction of arrow B, (i.e. toward a regular position). A cave 14 is formed in the substantially intermediate position of the key rotor 7, perpendicular to the central axis of the key rotor 7. A third spring 15 constituted by a compression coiled spring is slidably proVided in the cave 14 to urge limiting member 16 outwardly (i.e. in the direction of arrow C in FIG. 1). An end portion of the limiting member 16 passes through a long hole 17 provided in the intermediate portion of the operation member 3. When the operation member 3 is in its original position as shown in FIG. 1, the end portion of the limiting member 16 is flush with the outer circumference of the operation member 3 and abuts against the inner peripheral surface of the body 1. A long hole 18 is formed in the intermediate position of the body 1 to communicate the inside of the body with atmosphere.

Figure 6:
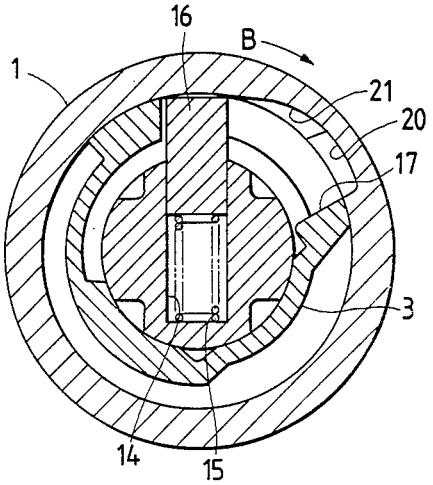
FIG. 6 is a sectional view taken along the line VI—VI of FIG. 1.

When the operation member 3 is pushed in a direction opposite arrow A and against the first spring 6, the long hole 18 communicates with the long hole 17 formed in the operation member 3. An engagement portion 19 is provided in a position where the top end of the limiting member 16 fits into the long hole 18 when the key rotor 7 is in the regular position. A groove portion 20 (FIG. 6) substantially U-shaped in section and extending forward from the long hole 17 is formed in a position shafted by about 60° in the direction of the arrow B from the engagement portion 19. In a position of the groove portion 20 which is predetermined-distance ahead the long hole 17 and faces the top end of the limiting member 16 in FIG. 1, a slope portion 21 gradually ascending from the bottom of the groove portion 20 toward the inside of the body 1 is provided as shown by the solid line in FIG. 6 and as shown by the broken line in FIG. 7. The groove portion 20 and the slope portion 21 form a disengagement portion 22.

A pair of mounting tongue-like portions 23 are united with and project from the body 1. The tongue-like portions 23 have mounting holes 23a. A cave 24 is formed in the key rotor 7 to be substantially parallel to the cave 14. A coiled spring 25 and a ball 26 are disposed in the cave 24. When the key rotor 7 is in its original position, the ball 26 fits into an engagement groove 27 formed in the inside of the operation member 3. A holder portion 28 is united with the body and capable of facing one of the convex portions 4. A forward end of an actuator 29a of a micro-switch 29, provided in the holder portion 28, is inserted into the body 1 from a notch portion 1b to the inside of the body 1 and faces one of the convex portions 4. When the operation number 3 is in its original position so that the actuator 29a is not pushed, the micro-switch is in an on-state.

Figure 3:
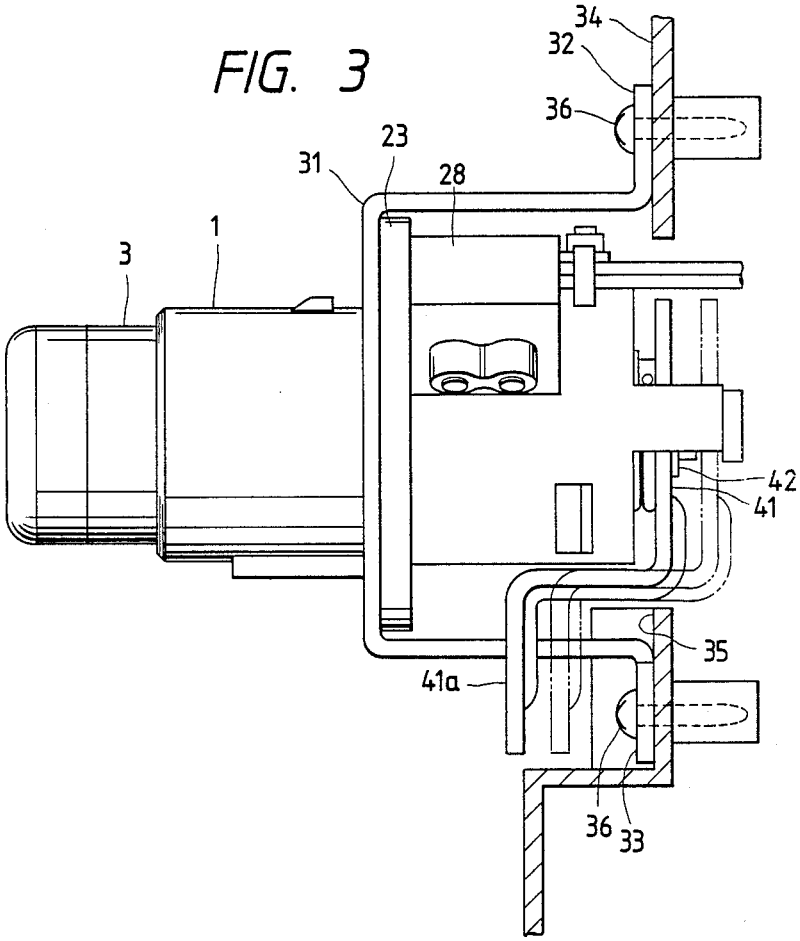
FIG. 3 is a side view of the locking apparatus.
Figure 4:
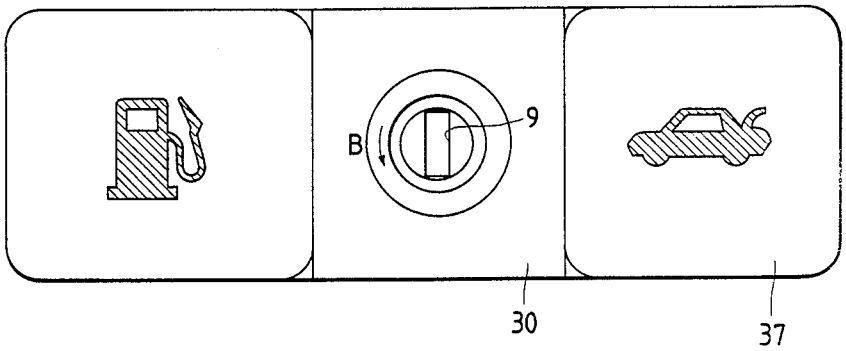
FIG. 4 is a front view of the locking apparatus.
Figures 8, 9:
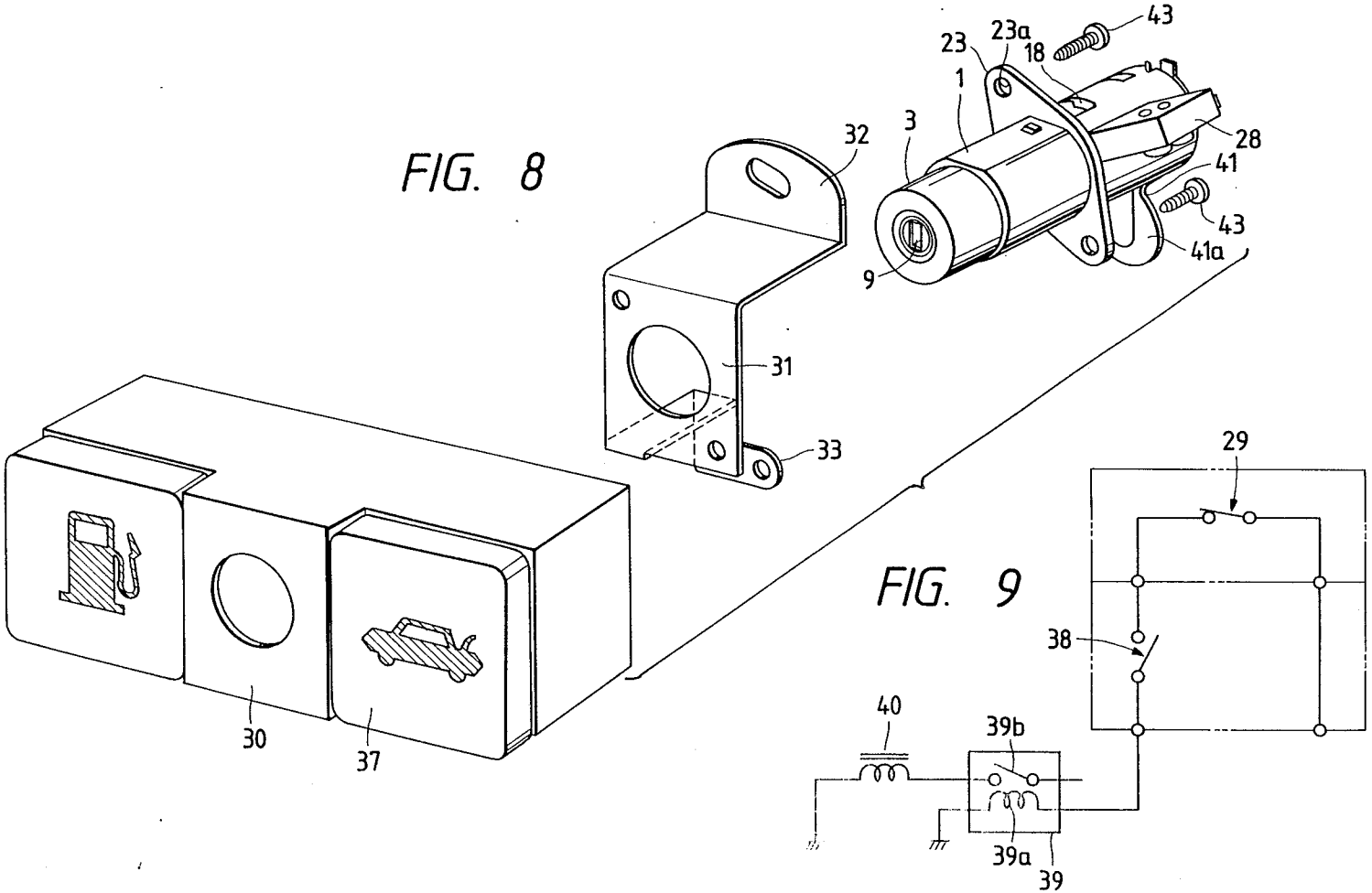
FIG. 8 is an exploded perspective view of the locking apparatus.
FIG. 9 is an electric circuit diagram of the locking apparatus.

As shown in FIG. 8, a cover frame 30 and a mounting metal fitting 31 are fixed to the front surfaces of the tongue-like portions 23 by screws 43. As shown in FIG. 3, mounting tongue-like portions 32 and 33 provided in the upper and lower sides of the mounting metal fitting 31 are fixed, by screws 36, to mounting portions 34 and 35 provided in the lower portion of the instrument panel of the car. The lower mounting portion 35 is erected at the outside of the mounting tongue-like portion 33 to thereby cover the outside of the mounting tongue-like portion 33.

As shown in FIG. 8, a trunk lid opening switch knob 37 is provided in the right side of the cover frame 30. When the switch knob 37 is turned to the front, a switch 38 shown in FIG. 9 is turned on. In FIG. 9, the switch 38 and the micro-switch 29 are connected in series to a relay coil 39a of a relay 39, and a trunk lid opening electromagnetic solenoid 40 is connected to a relay contact 39b.

On the other hand, a shielding metal fitting 41 is connected or fixed to the rear end portion of the key rotor 7 through a stop ring 42. The shielding metal fitting 41 is formed by bending a metal plate. When the key rotor 7 is in its original position, a shielding portion 41a at the forward end of the shielding metal fitting 41 is located to cover the portion in front of the screw 36 tightening the mounting tongue-like portion 33 to the mounting portion 35, over a predetermined distance from the head of the screw 36.

The operation of the apparatus constructed as described above will now be explained. When the operation member 3 is in its original position as shown in FIG. 1, the micro-switch 29 is in the on-state. Accordingly, when the switch 38 is turned on by the operation of the switch knob 37, the relay coil 39a is energized to turn on the relay switch 39b. Consequently, the electromagnetic solenoid 40 is energized through the relay switch 39b and operated to open the trunk lid (not shown).

On the other hand, if the drive leave the driver's seat and wants to prevent the trunk lid from being opened by another, the driver pushes the operation member 3 inwardly against the first spring 6. This causes the top end of the limiting member 16 facing the long hole 18 (shown in FIG. 2), to move in the direction of the arrow C by the elastic force of the spring 15, and enter the long hole 18. Accordingly, the top end portion of the limiting member 16 is engaged with the engagement portion 19 to thereby keep the operation member 3 in a pushed-in position (i.e., a locked position against the first spring 6). In this condition, the actuator 29a of the micro-switch 29 is pressed by one of the convex portions 4 to turn off the micro-switch 29. Thus, the relay coil 39a and the electromagnetic solenoid 40 are not energized and will not operate even if someone pulls the switch knob 37 forwards to turn on the switch 38. Accordingly, the trunk lid can be securely prevented from opening.

Figure 7:
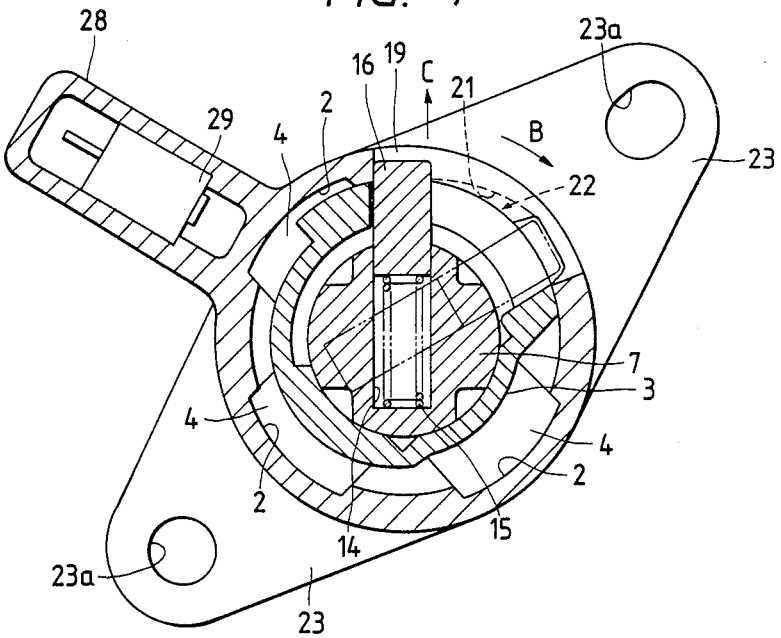
FIG. 7 is a sectional view taken along the line VII—VII of FIG. 2.

When, in this condition, the driver wants to open the trunk lid, the key 12 is inserted into the keyhole 9 in the key rotor 7. As shown in FIG. 2, the opposite end portion of the tumblers 11 are made even with outer circumference of the key rotor 7 to allow the key rotor 7 to be rotated. Accordingly, if the key 12 is rotated in the direction of the arrow B against the second spring 13, the top end portion of the limiting member 16 is move along the long hole 18 in the direction of the arrow B as shown in FIG. 7 and then disconnected from the engagement portion 19 to the groove portion 20. When the top end of the limiting member 16 is moved into the groove portion 20 as described above, its limiting function is canceled and the operation member 3 and the key rotor 7 are returned to their original positions by the elastic force of the first spring 6. When, in this condition, the force to rotate the key 12 is removed, the key rotor 7 is returned in the direction opposite the direction of arrow B by the elastic force of the second spring 13. After the key rotor 7 is rotated, the top end portion of the timing member 16 is moved in the direction reverse to arrow C by sliding along the slope portion 21 of the disengagement portion 22 to be returned to the cave 14 against the third spring 15. Finally, the top end of the limiting member 16 is returned to its original position to abut the inner peripheral wall of the operation member 3, so that the microswitch 29 is turned on. Accordingly, the trunk lid may be opened using switch knob 37 when switch 38 is turned on.

When the operation member 3 is pushed inwardly against the first spring 6 to be maintained in the locked position, the shielding portion 41*a* of the shielding metal fitting 41 covers the screw 36 tightening the lower mounting tongue-like portion 33 to the mounting portion 35. Further, when the key 12 is removed from the keyhole 9 of the key rotor 7, the key rotor 7 is in the regular position so that rotor rotation thereof is prevented. Accordingly, even if a thief wants to remove the screws 36 using tools to operate the micro-switch or other parts, the shielding portion 41*a* of the shielding metal fitting 41 securely prevents him from loosening the screw 36 tightening the lower mounting tongue-like portion 33 to the mounting portion 35. Thus, the trunk lid can be securely prevented from being opened by illegal means.

In the aforementioned embodiment, the risk that the trunk lid may be opened by some unexpected persons other than the driver when the driver leaves the driver's seat can be avoided simply by pushing the operation member 3 to the locked position. Further, unlike the conventional apparatus, the key is not used for the operation of pushing the operation member 3. Accordingly, the operation can be carried out speedily and easily. Consequently, the apparatus has excellent handling properties.

In the locked state, the shielding portion of the shielding member covers the head of the mounting screw to securely prevent the screw from being removed with tools such as a screw driver. Accordingly, the disadvantage that an unauthorized person may cancel the locked state by illegal means can be securely prevented. Consequently, the apparatus has excellent locking reliability.

Although the above embodiment has described a device where the micro-switch 29 is turned off to invalidate the trunk lid opening switch 38 when the operation member 3 is pushed to the locked position, the invention can also be applicable to a locking mechanism such as a trunk lid or a glove box lock that may be mechanically turned to a locked state when the operation member 3 is located in the locked position.

As apparent from above description, the present invention provides a key-including locking apparatus which comprises a cylindrical body, a cylindrical operation member placed in the inside of the body to be reciprocatingly movable along the axis thereof and urged by a first spring to return to its original position, a key rotor placed in the inside of the operation member to be rotatable relative to the operation member and movable together with the operation member along the axis relative to the body, the key rotor being rotatable relative to the operation member by insertion of a key and urged by a second spring to rotate to its original position, a limiting member provided in the key rotor and urged by a third spring to project outwardly from the outside of the key rotor, an engagement portion provided in the body to be engaged with the limiting member projected outwardly by the third spring when the operation member is forcedly moved inwardly by a predetermined stroke along the axis against the first spring by a manual operation, and a disengagement canceling portion provided in the body to unlock the limiting member from the engagement portion to thereby return the operation member and key rotor respectively to their original positions by the spring forces of the first and second springs when the operation member kept in a locked position is operated to be rotated against the second spring with the key inserted into the key rotor. Accordingly, the locked state can be attained only by pushing the operation member inwardly, so that the key is not used for attaining the locked state. Thus, the locking operation can be speedily and easily completed compared with the conventional apparatus. Consequently, the invention has excellent handling properties.

Furthermore, the apparatus according to the invention is characterized in that there is provided a shielding member fixed to the key rotor and having a shielding portion that covers the head of the screw when the key rotor is located in the regular position. Accordingly, when locked, the shielding portion of the shielding member provided in the key rotor located in a rotation disabled state covers the head of the mounting screw to prevent the screw from being removed by tools such as a screw driver. Accordingly, the disadvantage that unauthorized persons may cancel the locked state by illegal means can be securely prevented. Consequently, the invention has excellent locking reliability.

What is claimed is:

1. A locking apparatus with a key, comprising:

a cylindrical body having an axis;

a cylindrical operation member mounted inside said body, said operation member being movable along said axis of said body;

a first spring for producing an elastic force to return said operation member to an original position;

a key rotor mounted inside said operation member, said key rotor being rotatable with respect to said operation member using said key, said key rotor being movable together with said operation member along said axis with respect to said body;

a second spring for producing an elastic force to urge said key rotor to rotate to an original position;

a limiting member provided in said key rotor;

a third spring for urging said limiting member to project outwardly from said key rotor;

an engagement portion disposed in said body, said engagement portion being engaged with said limiting member projected outwardly by said third spring when said operation member is pushed inwardly by a predetermined stroke along said axis against said first spring by a manual operation; and a disengagement portion provided in said body, said disengagement portion unlocking said limiting member from said engagement portion, thereby returning said operation member and said key rotor to said respective original positions under said elastic forces of said first and second springs, in response to rotation of said key rotor.

2. The locking apparatus according to claim 1, further comprising:

a mounting portion secured to said body, said mounting portion having a mounting hole for receiving a mounting screw; and a shielding member secured to said key rotor, for covering a head of a mounting screw when said operation member is in a locked position.

3. The locking apparatus according to claim 2, wherein said shielding member is unitarily formed of a bent metal plate.

4. The locking apparatus according to claim 1, wherein said body is formed of plastic resin.

5. The locking apparatus according to claim 1, wherein said first spring is positioned between a rear end of said operation member and a support, and wherein said first spring comprises a compression coiled spring.

6. The locking apparatus according to claim 1, wherein said second spring is positioned between a rear end of said key rotor and said body, and wherein said second spring comprises a torsional coiled spring.

7. The locking apparatus according to claim 1, wherein said key rotor comprises first and second cave portions.

8. The locking apparatus according to claim 1, wherein said third spring is provided in said first cave portion of said key rotor, and said third spring comprises a compression coiled spring.

9. The locking apparatus according to claim 7, wherein said operation member comprises an engagement groove formed on an inside wall thereof, and said locking apparatus further comprises a ball located in said second cave portion of said key rotor and a coiled ball spring positioned in said second cave portion of said key rotor to urge said ball outwardly from said key rotor and into said engagement groove.

10. The locking apparatus according to claim 1, wherein said disengagement portion comprises a groove portion and a slope portion, said groove portion being formed in a position shifted by about 60° from said engagement portion, and said slope portion gradually ascending from a bottom of said groove portion toward an inside of said body.

* * * * *